US006237162B1

(12) United States Patent
Gill

(10) Patent No.: US 6,237,162 B1
(45) Date of Patent: May 29, 2001

(54) HELMET COVER WITH POSITIVE ATTACHMENT

(76) Inventor: Ronald Gill, 2873 Santa Paula Ct., Sacramento, CA (US) 95821

( * ) Notice: Subject to any disclaimer, the term of this patent is extended or adjusted under 35 U.S.C. 154(b) by 0 days.

(21) Appl. No.: 09/507,403

(22) Filed: Feb. 18, 2000

(51) Int. Cl.[7] ..... A42B 1/24
(52) U.S. Cl. ..... 2/422; 2/10; 2/175.6
(58) Field of Search ..... 2/422, 410, 195.4, 2/175.6, 175.3, 909, 918, 900, 10

(56) References Cited

U.S. PATENT DOCUMENTS

| | | | | |
|---|---|---|---|---|
| D. 344,844 | * | 3/1994 | Beitscher et al. | D2/869 |
| 1,737,289 | | 11/1929 | Young . | |
| 2,176,953 | | 10/1939 | Bloom . | |
| 2,911,652 | | 11/1959 | Ekman . | |
| 3,103,015 | * | 9/1963 | Plastino | 2/422 |
| 3,146,462 | * | 9/1964 | Militello | 2/410 |
| 3,203,003 | * | 8/1965 | Plastino | 2/422 |
| 3,447,162 | * | 6/1969 | Aileo | 2/420 |
| 4,097,930 | * | 7/1978 | Bay . | |
| 4,106,124 | * | 8/1978 | Green | 2/422 X |
| 4,117,553 | | 10/1978 | Bay . | |
| 4,316,289 | | 2/1982 | Hild . | |
| 4,333,180 | | 6/1982 | Bay . | |
| 4,495,657 | | 1/1985 | Bay . | |
| 4,599,752 | | 7/1986 | Mitchell . | |
| 4,993,082 | | 2/1991 | Gentes et al. . | |
| 5,481,759 | | 1/1996 | Rinaldi . | |
| 5,519,895 | | 5/1996 | Barnes, Jr. . | |
| 5,724,681 | * | 3/1998 | Sykes | 2/422 X |
| 5,727,250 | | 3/1998 | Black . | |
| 5,896,587 | * | 4/1999 | Gentry | 2/422 X |
| 6,061,836 | * | 5/2000 | Peters | 2/175.6 |

FOREIGN PATENT DOCUMENTS

| | | | |
|---|---|---|---|
| 3619282 | * | 12/1987 | (DE) . |
| 2680305 | * | 2/1993 | (FR) . |

* cited by examiner

*Primary Examiner*—Rodney Lindsey
(74) *Attorney, Agent, or Firm*—Audrey A. Millemann

(57) ABSTRACT

A cover for a helmet includes a covering portion having side portions, a top portion, a lower elastic edge, and means for attaching the covering portion to the helmet. A covered helmet assembly includes a beanie-type motorcycle helmet with a removable, mating covering portion. The covering portion includes side portions and a top portion, and a lower, elastic edge. The covering portion further includes three female snap fastener portions on a front, interior surface thereof, spaced and adapted to mate with three similarly-positioned male snap fastener portions on a front, exterior surface of the motorcycle helmet. The covering portion also includes a selectively-releasable, mating hook and loop fabric patch pair wherein the loop portion is located on the covering portion's rear, interior surface and the hook portion is located on the helmet's rear, exterior surface. A visored, covered helmet assembly includes a helmet, a covering portion and a visor. The visor includes a horizontally-projecting peak, and a generally vertical flange. The flange includes an inner surface with three female snap fastener portions adapted to mate with the three male snap fastener portions on the helmet's front, exterior surface. The flange also includes three male snap fastener portions on its outer surface, adapted to mate with the three female snap fastener portions on the covering portion's front, interior surface.

7 Claims, 3 Drawing Sheets

HELMET COVER WITH POSITIVE ATTACHMENT

BACKGROUND OF THE INVENTION

1. Field of the Invention

The present invention relates generally to covers for helmets, and more specifically to covers for motorcycle helmets.

2. Description of the Related Art

Many states require motorcycle riders to wear helmets. Riders may feel oppressed by these laws and may wish to express their individuality, rebellious nature, or other feelings. Other riders choose to wear helmets for safety reasons, even where not legally required, and may be dissatisfied with the limited range of helmet styles available. One way to address these concerns is to add covers to such helmets.

The related art includes various types of covers for a variety of different kinds of helmets. U.S. Pat. No. 5,519,895 issued to Barnes, Jr. ('895) discloses a fabric baseball cap used to cover a sports helmet held in place by an elastic band. U.S. Pat. No. 4,599,752 issued to Mitchell ('752) discloses a removable interlocking cap, made of colored flexible plastic, for a sports helmet to allow individual players and teams to be easily distinguished by the color of the helmet caps and to allow the color to be changed quickly. U.S. Pat. No. 2,911,652 issued to Ekman ('652) discloses a plastic foil (polyvinyl chloride film) camouflaging cover for a military helmet, held in place with an elastic drawstring or band. U.S. Pat. Nos. 4,316,289 and 5,727,250, issued to Hild and Black, respectively, disclose sun shields for use with construction hard hats. The Hild patent describes a rigid plastic sun shield frictionally attached to the hard hat, while the Black patent describes a fabric covered vinyl sunshade attached with an elastic band.

The helmet covers in the related art are not satisfactory for use with certain types of motorcycle helmets because they do not serve to disguise the helmet, and do not attach securely enough to the helmet to remain in place when the wearer is riding a motorcycle at a high speed.

SUMMARY OF THE INVENTION

The helmet cover of the present invention is adapted to overcome the above-noted shortcomings and to be visually interesting and lightweight. The inventive cover can be made of almost any kind of material and can have emblems, designs, or other items attached thereto.

One aspect of the invention comprises means for covering a helmet, such as a motorcycle helmet, and means for attaching the covering means to the helmet such that the covering means will not become detached when the helmet is worn by a person riding a motorcycle at a high speed.

Another aspect of the invention comprises a covered helmet assembly. The covered helmet assembly comprises a helmet, means for covering the helmet, and means for attaching the covering means to the helmet.

A third aspect of the invention comprises a covered visored helmet assembly. The covered visored helmet assembly comprises a helmet, means for covering the helmet, means for attaching the covering means to the helmet, and the additional element of a detachable visor.

It is an object of the invention to provide a removable cover for a helmet that disguises the helmet and is also visually interesting.

It is another object of the invention to provide a removable helmet cover that is lightweight.

It is also an object of the invention to provide a helmet cover that will remain attached to the helmet when the wearer is riding a motorcycle at a high speed, and yet is easily removable.

It is a further object of the invention to provide a removable helmet cover that can be attached to a motorcycle helmet also having a detachable visor.

Still further objects of the invention disclosed herein will be apparent from the drawings and following detailed description thereof.

DETAILED DESCRIPTION OF THE PREFERRED EMBODIMENTS OF THE INVENTION

The covered helmet assembly of the invention includes a helmet and a removable covering. One embodiment consists of a helmet and a covering. A second embodiment also includes a detachable visor.

Figure 1:
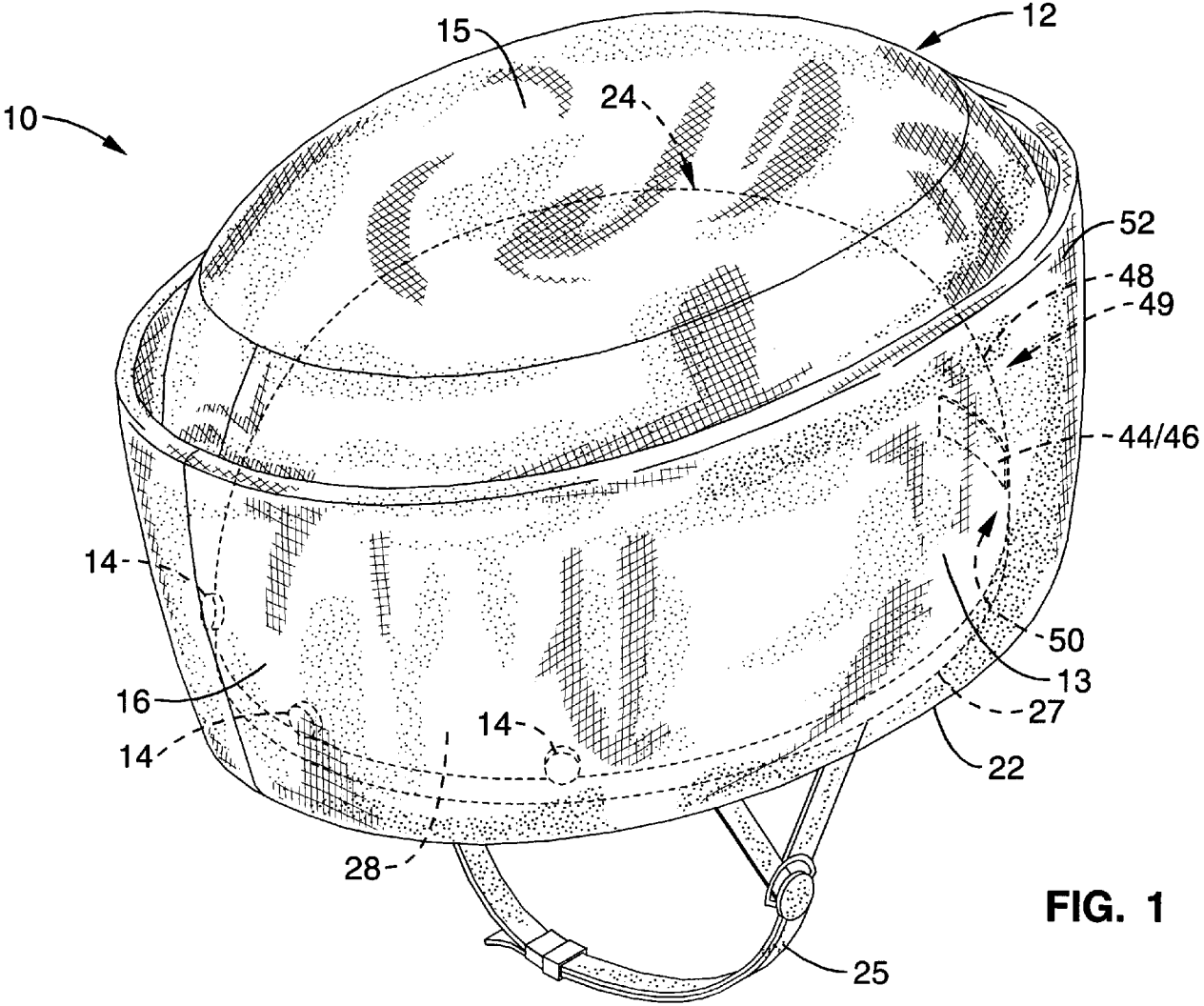
FIG. 1 is a perspective view of the helmet and cover.

FIG. 1 shows the first embodiment of the invention, comprising helmet cover 10 and helmet 24. Helmet cover 10 is comprised of covering portion 12 and three female snap fastener portions 14 affixed to covering portion 12. Covering portion 12 is preferably constructed of flexible material. A variety of materials is suitable, including woven and non-woven fabrics and textiles constructed of natural or synthetic fibers, as well as natural and synthetic furs, plastics and other flexible materials known in the art. Covering portion 12 has the shape and dimensions to fit snugly over a helmet, such as beanie-type motorcycle helmet 24. Covering portion 12 is generally oval in shape.

Covering portion 12 has a front portion 16. Front portion 16 has an interior surface 18. Covering portion 12 also has a lower edge 22. Lower edge 22 may be resilient or stretchable. For example, lower edge 22 may include band of elastic material 23 adapted to grip a helmet's lower edge 27 by curling under edge 27. Female snap fastener portions 14 are affixed to front, interior surface 18 of covering portion 12. Female snap fastener portions 14 are positioned approximately three and a half inches, or so, apart from each other.

It shall be understood that the covering portion of the invention is not limited to the configuration shown by way of example, herein. The covering portion may be of nearly any shape, and need not be a hat, per se. For example, it may also cover less than the helmet's surface and thus be in the general shape of a conventional headband, having generally vertical sides 13 but no top 15, thus allowing the crown, or upper portion, of the helmet to show above sides 13. The general concept of the covering portion may also include shapes or features such as, without limitation, peaks, brims, bands or the like suggesting conventional hats such as, without limitation, a ball cap, a fedora, a cowboy hat, a derby, a tam-o-shanter, a beret, a fez, a top hat, a garrison cap, a turban, a tricorn, a busby, a crown or a beanie (with or without propeller). The covering portion may also include such fanciful features as, without limitation, tails, tassels, feathers, horns, antlers, ears, representations of faces or animals, cartoons or caricatures and various outward-projecting spikes and protuberances, as well as bells or whistles.

Helmet 24 is preferably constructed of the rigid materials used in the manufacture of conventional motorcycle helmets. Helmet 24 is conveniently a beanie-type helmet, as shown. A conventional chin strap 25, depends therebeneath. Helmet 24 has a front portion 26 and a lower edge 27. Front portion 26 has an exterior surface 28. Three male snap fastener portions 30 are affixed to front, exterior surface 28 of helmet 24. Male snap fastener portions 30 are positioned approximately three and a half inches, or so, apart from each other, the standard distance of such items on helmets.

It shall be understood that snap fastener portions 14, 30 and 40, and the snap fastener portions in the embodiments to follow, may be rearranged to substitute male for female, and vice versa, without materially affecting the function of the invention. Further, the scope of the invention includes other equivalent fasteners known in the art to be equivalent to snap fasteners.

In use, in the first embodiment, helmet 24 is removably attached to covering portion 12 by the mating of helmet 24's three female snap fastener portions 30 with covering portion 12's three male snap fastener portions 14.

Figure 2:
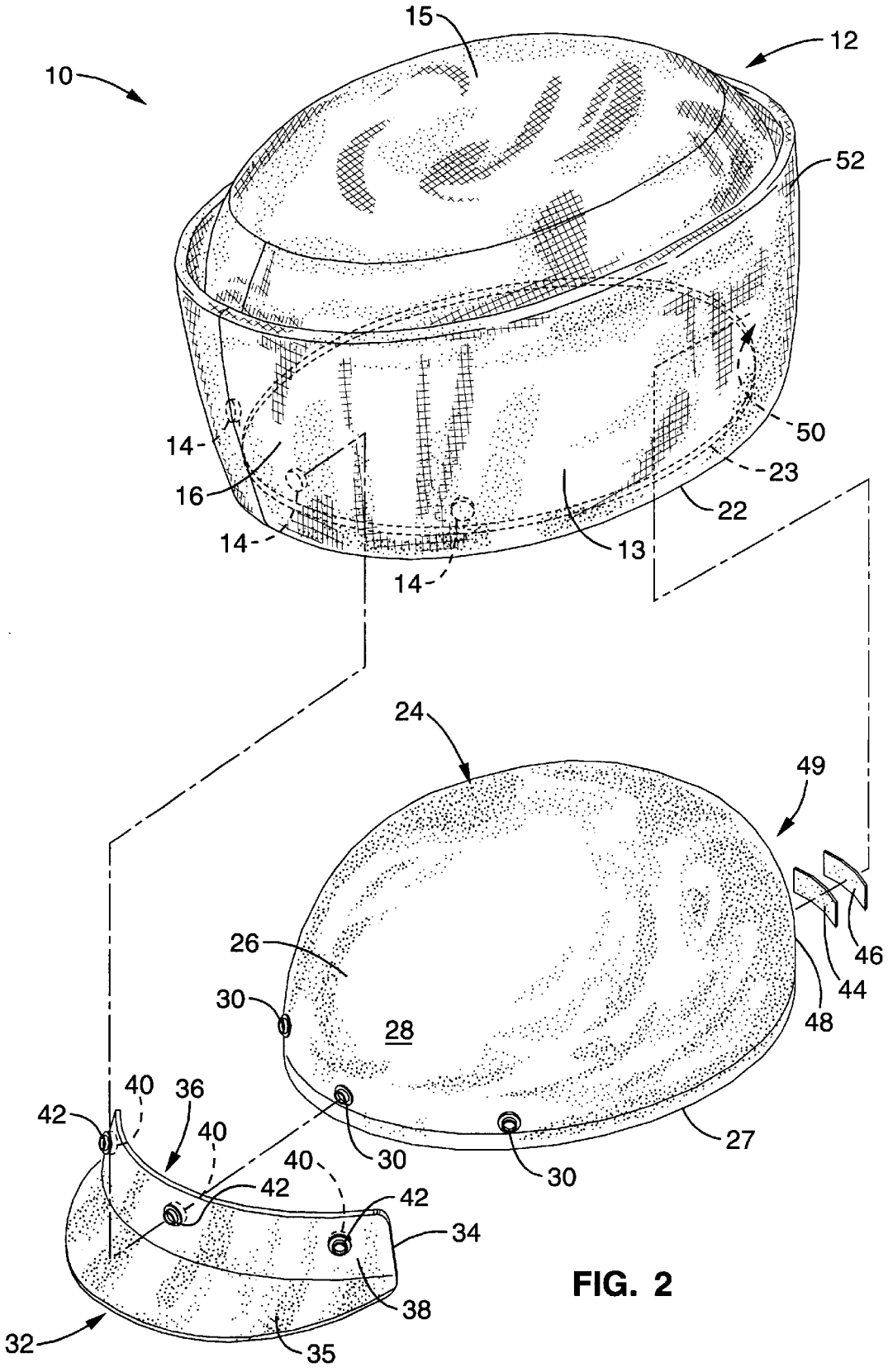
FIG. 2 is an exploded perspective view, showing the components of the covered helmet assembly with a visor.
Figure 3:
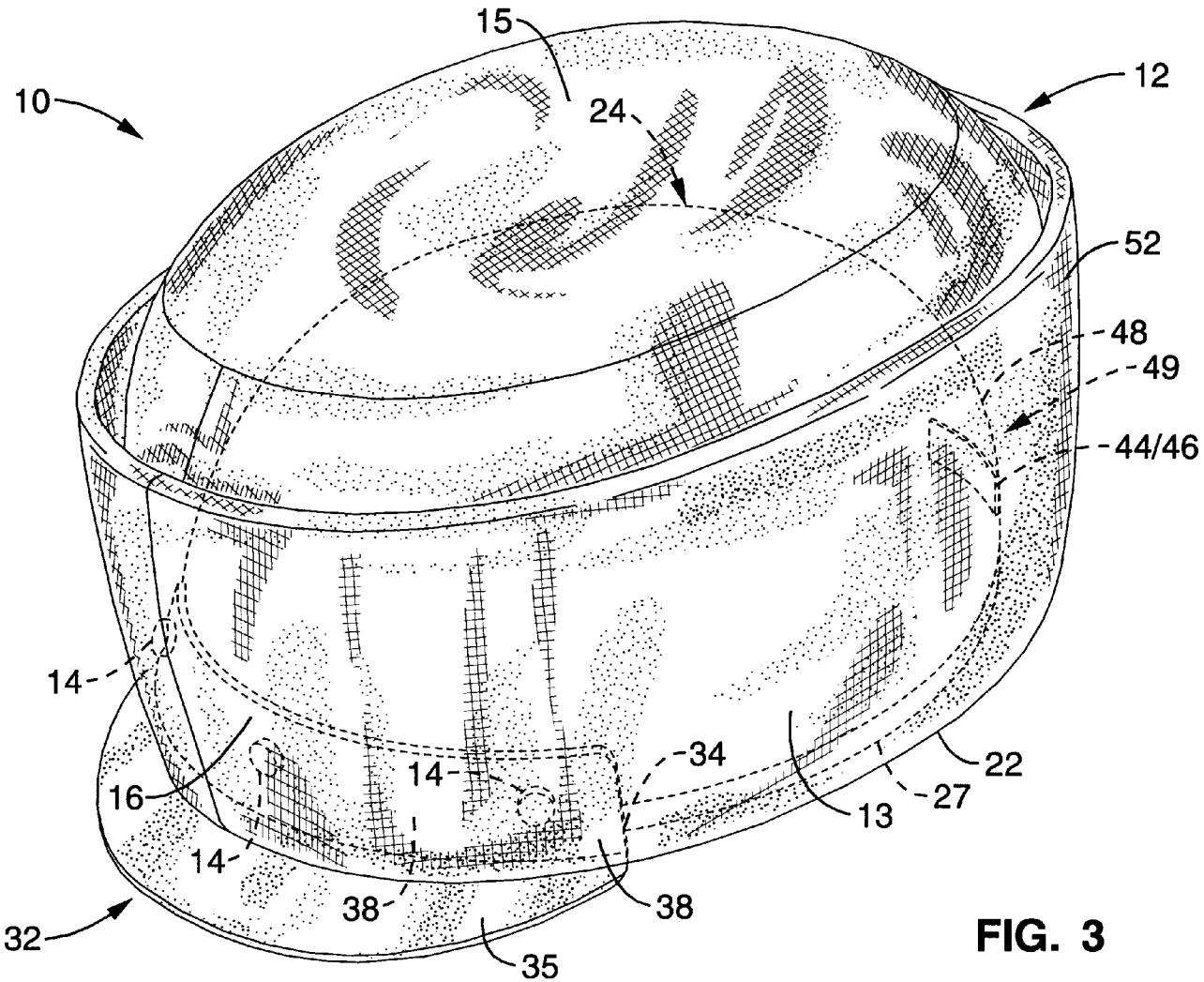
FIG. 3 is a perspective view of the covered helmet assembly with a visor.

FIGS. 2 and 3 show the second embodiment of the invention, comprising helmet cover 10, helmet 24, and visor portion 32. Visor portion 32 is preferably constructed of a rigid plastic material. Visor portion 32 has a generally vertical flange 34 and a generally horizontal peak 35. Vertical flange 34 has an inner surface 36 and an outer surface 38. Three female snap fastener portions 40 are affixed to inner surface 36 of vertical flange 34. Three male snap fastener portions 42 are affixed to outer surface 38 of vertical flange 34. Female snap fastener portions 40 are positioned three and a half inches, or so, apart from each other. Male snap fastener portions 42 are similarly positioned three and a half inches, or so, apart from each other. Ideally, each of vertical flange 34's snap fasteners is a single unit, having its female portion 40 inside, and its male portion 42 outside.

In use, in the second embodiment, visor portion 32 is removably attached to helmet 24 by the mating of helmet 24's three male snap fastener portions 30 with visor portion 32's three female snap fastener portions 40. Covering portion 12 is removably attached to visor portion 32 by the mating of covering portion 12's three female snap fastener portions 14 with visor portion 32's three male snap fastener portions 42.

The aforedescribed helmet cover construction and covered helmet assembly are expected to work satisfactorily for the purposes described. However, for a further positive attachment between covering portion 12 and helmet 24, one or more selectively-releasable, mating hook and loop fabric patch pairs, 44 and 46, may be employed. Fabric patches 44 and 46 are preferably securely disposed between the exterior surface 48 of rear portion 49 of helmet 24, and the interior surface 50 of rear portion 52 of covering portion 12. Fabric patches 44 and 46 are preferably of the type sold under the trademark Velcro, or the equivalent, and consist of corresponding hook and loop portions. Each should have an adhesive backing suited to bind it to the composition of the backing surface to which it will be adhered, i.e. either to the painted, polished fiberglass exterior surface 48 of helmet 24, or to the fabric of interior surface 50 of covering portion 12. The fabric patch portion secured to covering portion 12 may be sewed, as well. Each fabric patch 44, 46 should be of sufficient size to permit a bit of adjustability in the alignment of covering portion 12 with helmet 24.

It is contemplated that hook and loop fabric patches 44 and 46 may be offered along with covering portion 12 as a kit, wherein the user executes the placement of the fabric patch on the helmet. That may be expediently accomplished, for example, by having the fabric patches already engaged with one another on covering portion 12's interior surface, with a backing sheet covering an adhesive surface on the fabric patch to be adhered to helmet 24. That backing sheet may simply be peeled off to expose the adhesive such that the adhesive will adhere to helmet 24's rear, exterior surface 48 upon the first application of covering portion 12 to helmet 24.

In general, either hooked fabric patch 44 or looped fabric patch 46 could be located on either helmet 24's rear, exterior surface 48, or on covering portion 12's rear, interior surface 50. However, it is also contemplated that covering portion 12 may be wearable as a conventional hat, without a helmet therebeneath. Thus, for comfort, it is preferred that hooked fabric patch 44 be located on helmet 24's exterior surface 48, and that looped fabric patch 46 be located on covering portion 12's interior 13 surface 50. That way, if covering portion 12 is being used as a conventional hat, its interior surface will not bear uncomfortable patches of hooked Velcro fabric, close to the hair or skin of the user. Looped fabric patch 46 is expected to be much more comfortable.

It is also contemplated that the fabric patch to be disposed on the helmet may be chosen in a color most closely matching the helmet's color. That would least detract from the helmet's appearance when covering portion 12 is not being used.

In use, it is likely best to engage, first, the snaps at the fronts 16 and 26 of covering portion 12 and helmet 24, respectively, and then to adjust covering portion 12 toward the rear of helmet 24 to engage fabric patches 44 and 46. Removal is best accomplished in the reverse order.

The foregoing disclosure of the covered helmet assembly is illustrative of the preferred embodiment of the invention and is not a limitation on the scope of the invention or the claims. Those skilled in the art will envision many other possible variations of the structure disclosed herein that nevertheless fall within the scope of the following claims.

And, alternative uses for this inventive cover and assembly may later be realized. For example, skiers, snowboarders, bicyclists, skateboarders, roller and inline skaters, ice skaters, rock climbers, football players, sky divers and enthusiasts of many other physical, more or less dangerous, sports and activities may find that the helmet cover and assembly of the invention yields great utility in their respective endeavors. Accordingly, the scope of the invention should be determined with reference to the appended claims and not by the examples given.

I claim:

1. A covered visored helmet assembly, comprising:

a. a helmet having a lower edge and a front, exterior surface, wherein said front, exterior surface has a plurality of male snap fastener portions affixed to said front, exterior surface;

b. a detachable visor portion having a vertical flange, said flange having inner and outer faces, and a plurality of inner female snap fastener portions and a plurality of outer male snap fastener portions, wherein said visor portion is adapted to be attached to said helmet by mating said visor portion's female snap fastener portions with said helmet's male snap fastener portions; and, c. a covering portion of a size and shape adapted to fit over said helmet, having a front, interior surface, said front, interior surface of said covering portion having a plurality of female snap fastener portions, wherein said covering portion is attached to said visor portion by mating said covering portion's female snap fastener portions with said visor portion's male snap fastener portions.

2. The assembly of claim 1, wherein said covering portion is constructed of flexible material.

3. The assembly of claim 1, wherein said covering portion has a stretchable lower rim.

4. The assembly of claim 1, wherein said covering portion has a stretchable lower rim adapted to curl under said lower edge of said helmet.

5. The assembly of claim 1, wherein:

a. said helmet's plurality of male snap fastener portions comprises three male snap fastener portions;

b. said visor's plurality of female snap fastener portions comprises three female snap fastener portions;

c. said visor's plurality of male snap fastener portions comprises three male snap fastener portions; and, d. said covering portion's plurality of female snap fastener portions comprises three female snap fastener portions.

6. The assembly of claim 1, further comprising:

a. a rear, exterior surface of said helmet;

b. a rear, interior surface of said covering portion;

c. a loop portion of a mating hook and loop fabric patch pair affixed to said rear, interior surface of said covering portion; and, d. a hook portion of a mating hook and loop fabric patch pair affixed to said rear, exterior surface of said helmet, said hook portion positioned to be mated with said loop portion.

7. A covered visored helmet assembly, comprising:

a. a helmet having a lower edge, a front, exterior surface, and a rear, exterior surface;

b. a plurality of male snap fastener portions affixed to said front, exterior surface of said helmet;

c. a detachable visor portion having a vertical flange, said flange having inner and outer faces, and a plurality of inner female snap fastener portions and a plurality of outer male snap fastener portions, wherein said visor portion is adapted to be attached to said helmet by mating said visor portion's female snap fastener portions with said helmet's male snap fastener portions;

d. a covering portion of a size and shape adapted to fit over said helmet, said covering portion having a front, interior surface, a rear, interior surface, and a stretchable lower rim;

e. a plurality of female snap fastener portions affixed to said front, interior surface of said covering portion, wherein said covering portion is attached to said visor portion by mating said covering portion's female snap fastener portions with said visor portion's male snap fastener portions;

f. a loop portion of a mating hook and loop fabric patch pair affixed to said rear, interior surface of said covering portion; and, g. a hook portion of a mating hook and loop fabric patch pair affixed to said rear, exterior surface of said helmet, said hook portion positioned to be mated with said loop portion.

* * * * *